US011547269B2

(12) United States Patent
Friedke et al.

(10) Patent No.: US 11,547,269 B2
(45) Date of Patent: Jan. 10, 2023

(54) HOUSEHOLD APPLIANCE

(71) Applicant: BSH Hausgeräte GmbH, Munich (DE)

(72) Inventors: Aaron Friedke, Lauingen (DE); Ersin Isbilen, Lauingen (DE); Alexander Schiele, Herbrechtingen (DE); Martin Rittner, Welden (DE); Martin Heinle, Glött (DE)

(73) Assignee: BSH Hausgeräte GmbH, Munich (DE)

( * ) Notice: Subject to any disclaimer, the term of this patent is extended or adjusted under 35 U.S.C. 154(b) by 435 days.

(21) Appl. No.: 16/644,982

(22) PCT Filed: Oct. 4, 2018

(86) PCT No.: PCT/EP2018/076945
§ 371 (c)(1),
(2) Date: Mar. 6, 2020

(87) PCT Pub. No.: WO2019/076636
PCT Pub. Date: Apr. 25, 2019

(65) Prior Publication Data

US 2020/0281438 A1 Sep. 10, 2020

(30) Foreign Application Priority Data

Oct. 17, 2017 (DE) ..... 10 2017 218 493.0

(51) Int. Cl.
*A47L 15/42* (2006.01)
*D06F 37/28* (2006.01)
(Continued)

(52) U.S. Cl.
CPC ..... *A47L 15/4259* (2013.01); *A47L 15/4261* (2013.01); *E05F 15/53* (2015.01); *E05F 15/627* (2015.01); *D06F 37/28* (2013.01); *E05Y 2201/434* (2013.01); *E05Y 2201/448* (2013.01); *E05Y 2201/626* (2013.01); *E05Y 2201/654* (2013.01); *E05Y 2201/688* (2013.01);
(Continued)

(58) Field of Classification Search
None
See application file for complete search history.

(56) References Cited

U.S. PATENT DOCUMENTS

2004/0050379 A1 3/2004 Kuttalek
2004/0113531 A1 6/2004 Raches
(Continued)

FOREIGN PATENT DOCUMENTS

CN 201312793 Y 9/2009
CN 203814939 U 9/2014
(Continued)

OTHER PUBLICATIONS

National Search Report DE 10 2017 218 493.0 dated Jun. 12, 2018.
(Continued)

*Primary Examiner* — Levon J Shahinian
(74) *Attorney, Agent, or Firm* — Michael E. Tschupp; Andre Pallapies; Brandon G. Braun

(57) ABSTRACT

A household appliance includes a housing, a door pivotably connected to the housing, a cable connected to the door, a roller in contact with the cable, and a motor configured to drive the roller to move the cable such as to effect a pivoting movement of the door.

18 Claims, 4 Drawing Sheets

(51) Int. Cl.

| | |
|---|---|
| ***E05F 15/53*** | (2015.01) |
| ***E05F 15/627*** | (2015.01) |
| ***F24C 15/02*** | (2006.01) |

(52) U.S. Cl.
CPC ... *E05Y 2201/704* (2013.01); *E05Y 2900/304* (2013.01); *F24C 15/02* (2013.01)

(56) References Cited

U.S. PATENT DOCUMENTS

| | | | | |
|---|---|---|---|---|
| 2004/0163684 | A1* | 8/2004 | Hapke ..... | A47L 15/4259 134/57 DL |
| 2006/0102165 | A1 | 5/2006 | Lockhart | |
| 2018/0328593 | A1 | 11/2018 | Grobleben et al. | |

FOREIGN PATENT DOCUMENTS

| | | | |
|---|---|---|---|
| CN | 104384750 | A | 3/2015 |
| DE | 102011084300 | A1 | 4/2013 |
| EP | 0541974 | A1 | 5/1993 |
| EP | 2336469 | A2 | 6/2011 |
| WO | 2010139536 | A1 | 12/2010 |

OTHER PUBLICATIONS

International Search Report PCT/EP2018/076945 dated Jan. 7, 2019.
National Search Report CN 2018800675681 dated Sep. 1, 2022.

* cited by examiner

HOUSEHOLD APPLIANCE

CROSS-REFERENCES TO RELATED APPLICATIONS

This application is the U.S. National Stage of International Application No. PCT/EP2018/076945, filed Oct. 4, 2018, which designated the United States and has been published as International Publication No. WO 2019/076636 A1 and which claims the priority of German Patent Application, Serial No. 10 2017 218 493.0, filed Oct. 17, 2017, pursuant to 35 U.S.C. 119(a)-(d).

BACKGROUND OF THE INVENTION

The present invention relates to a household appliance, in particular a water-using household appliance.

Many household appliances, such as household dishwashers for example, comprise a pivotable door. Furthermore, the household appliance can comprise a device which can compensate for the weight of the door, in order to prevent the door from falling down in its open position. For this purpose the device for example comprises a cable which is connected by one end to the door and by its other end to a spring element. The spring element is in turn for example connected to a housing of the household appliance. During an opening movement of the door, the spring is for example pretensioned, so that a spring force acts on the door with the aid of the cable such that the door is prevented from falling down. Friction elements can furthermore be provided, which make a pivoting movement of the door more difficult. In the open position of the door a corresponding friction force can form a difference between the weight of the door, which pulls on the cable, and the spring force.

EP 0 541 974 A1 shows for example a dishwasher with a device housing in which an electromotive drive is provided. With the aid of the electromotive drive a device door of the dishwasher can for example be closed or opened fully or partially.

BRIEF SUMMARY OF THE INVENTION

Against this background an object of the present invention consists in providing an improved household appliance.

Accordingly a household appliance, in particular a water-using household appliance, is provided, with a housing, a door pivotably connected to the housing, a cable connected to the door, a roller in contact with the cable, and a motor which is designed to drive the roller to move the cable such that a pivoting movement of the door is brought about.

Because the cable, which is connected to the door, is moved directly by a driven roller, an especially space-saving arrangement can be provided. For example, with the aid of the driven roller, influence can be exerted directly on the pivoting movement of the door. In addition a household appliance can be provided, in which an automatic door pivoting movement can be achieved with a small number of components.

The household appliance is preferably a water-using household appliance, in particular a household dishwasher. For example, the household appliance is a washing machine, a refrigeration device, preferably a refrigerator, or an oven. The housing preferably comprises a base housing and a dishwasher cavity, wherein the dishwasher cavity is arranged on the base housing. The door is preferably pivotably connected to the housing with the aid of a hinge. For example, the door is pivoted towards a base on which the household appliance stands.

"Roller" here for example means a rotatably mounted element which in particular exhibits a rotational symmetry to a central axis. The roller may for example also be referred to as a cable roller. In this case a cable is in contact with the roller along a wrap angle, wherein for example the wrap angle remains, in particular substantially, constant during a movement of the cable. In other words, for example, a size of a contact surface between the cable and the roller remains constant. The cable preferably comprises plastic or metal. Alternatively or additionally the cable can comprise yarn or textiles, in particular natural fibers and/or chemical fibers. For example, the cable is formed from several cable sections which are mechanically connected to one another. For example, the cable has no permanent connection to the roller, but merely has an abutting contact to the roller. The roller acts as a direct drive of the cable. For example, the cable is driven merely by means of the roller.

According to one embodiment the roller and the cable are designed such that a transfer of drive force from the roller to the cable takes place exclusively with the aid of a frictional force-fit.

The transfer of drive force preferably takes place from the roller to the cable with the aid of cable friction. Thanks to the cable force produced a tangential static friction force develops for example along a roller periphery that is touched, and is used to bring about the door movement. Advantageously a tensile force on the door, which is caused by the cable, can thereby be limited, since abrasion resistance starts at a contact surface between the cable and the roller after a limit tensile force is exceeded. This has the advantage that a safety device can be created. As a result it is possible to prevent body parts trapped between the door and the housing from being crushed. Furthermore, damage to objects with which the door collides can be prevented.

According to a further embodiment the door has a lever, to which one end of the cable is connected, wherein the door, the motor and the cable are designed such that a change in a tensile force on the lever with the help of the motor and the cable causes the pivoting movement of the door.

Preferably the door comprises a plate-shaped door section, the hinge and the lever. The door section can be pivoted about the hinge with the aid of the hinge. Preferably the lever is integrally molded onto the door section such that the change in the tensile force on the lever causes the pivoting movement of the door section. For example, the door can comprise a further lever, to which a further cable is connected. The levers can for example each be arranged on external sides of an underside of the door section. For example, the lever is and/or the levers are connected rigidly (not rotatably) to the door section.

According to a further embodiment the household appliance comprises a spring element which is connected to the housing and to the cable and is designed to at least partially compensate for a weight of the door.

The advantage of this is that it is possible to prevent the door from falling open in an uncontrolled manner. Furthermore, manual closing of the door is facilitated. The spring element is preferably a screw spring. For example, a characteristic spring curve of the spring element is progressive, degressive or linear. For example, the spring element is elongated and thereby pretensioned when an opening angle of the door is increased. The spring element is preferably embodied as a tensile spring. The cable is preferably provided as a continuous cable between the roller and the lever and between the roller and the spring element.

According to a further embodiment the cable has a wrap angle around the roller of between 360° and 540°, preferably between 400° and 500°, further preferably between 425° and 475° and even further preferably between 545° and 455°.

Advantageously the wrap angle is selected such that sufficient tensile force can be applied to the lever, without the cable sliding over the roller. For example, the wrap angle is precisely 450°.

According to a further embodiment the roller is connected to, so as to be driven by, the motor.

A drive connection between the roller and the motor is preferably free from cables and/or belts. For example the drive connection takes place between the roller and the motor exclusively with the aid of solid bodies (in other words without cables or belts). Advantageously a torque of the motor can thereby be transferred to the roller reliably and with low vibration.

According to a further embodiment the motor is connected to, so as to be driven by, the roller, with the aid of a gearing, in particular a worm gearing.

Using a gearing has the advantage that a speed and the torque of the motor can be converted such that the rotational movements of the roller can be optimally adapted to the requirements of a door opening mechanism.

According to a further embodiment the gearing is designed to inhibit a movement of the roller.

The gearing is preferably designed to inhibit a movement of the roller initiated from outside the gearing. If for example tensile forces on the cable change when the motor is inactive, the roller is locked. "Inhibit" here means a locking of the roller in respect of a rotational degree of freedom. Such inhibiting is preferably brought about with the aid of the worm gear.

According to a further embodiment the household appliance comprises a control device which is designed to actuate the motor such that the pivoting movement of the door is brought about.

Advantageously a fully automatic pivoting movement of the door can for example be achieved thereby. For example, the control device and the motor are coupled to one another using signaling technology.

According to a further embodiment the control device is designed to actuate the motor such that the door executes a complete opening movement and/or a partial opening movement and/or a complete closing movement and/or a partial closing movement.

The advantage of this is that different and automated opening or closing functions of the door can be implemented in the household appliance. In the case of an automatic closing movement of the door a rotary direction of the cable roller is changed compared to the opening movement of the door. This takes place preferably by means of corresponding actuation of the motor with the aid of the control device. For example, it is further possible to execute a complete opening movement and/or a partial opening movement and/or a complete closing movement and/or a partial closing movement of the door manually.

According to a further embodiment the household appliance comprises a user interface which is designed to communicate with the control device to actuate the motor.

For example, the user interface comprises a push button, a touch display, a microphone or another input device or output device. Furthermore, the user interface can comprise a sensor which is designed to detect a user input, in particular a gesture by the user.

According to a further embodiment the cable and the roller are designed such that when an opening angle of the door is changed by a manual force acting on the door the cable slides over the roller.

For example, the sliding starts when the movement of the roller is inhibited with the aid of the gearing. For example, the load on one end of the cable is relieved because of the manual force, for example when the opening angle of the door is reduced, so that pulling on the other end of the cable by means of the spring element causes the cable to slide over the roller.

According to a further embodiment the motor is embodied as an electric motor, as a hydraulic motor or as a pneumatic motor.

The motor is preferably connected to the housing. This means for example that the torque of the motor is supported on the housing.

According to a further embodiment the household appliance comprises a deflection roller which is designed to deflect the cable between the roller and the door.

With the aid of such a deflection roller the guidance of a cable can be perfectly matched to the basic geometric conditions in the household appliance. Furthermore, the wrap angle of the cable can be configured around the roller with the aid of the deflection roller. The roller too is for example designed to deflect the cable between the spring element and the deflection roller or the door.

According to a further embodiment, the household appliance is embodied as a household dishwasher.

Further possible implementations of the invention also comprise combinations—not explicitly cited—of features or forms of embodiment described above or below in respect of the exemplary embodiments. Here the person skilled in the art will also add individual aspects as improvements or amendments to the respective basic form of the invention.

BRIEF DESCRIPTION OF THE DRAWINGS

Further advantageous embodiments and aspects of the invention are the subject matter of the dependent claims as well as the exemplary embodiments of the invention described below. The invention is described below in greater detail on the basis of preferred embodiments with reference to the attached figures.

DETAILED DESCRIPTION OF EXEMPLARY EMBODIMENTS OF THE PRESENT INVENTION

Figure 1:
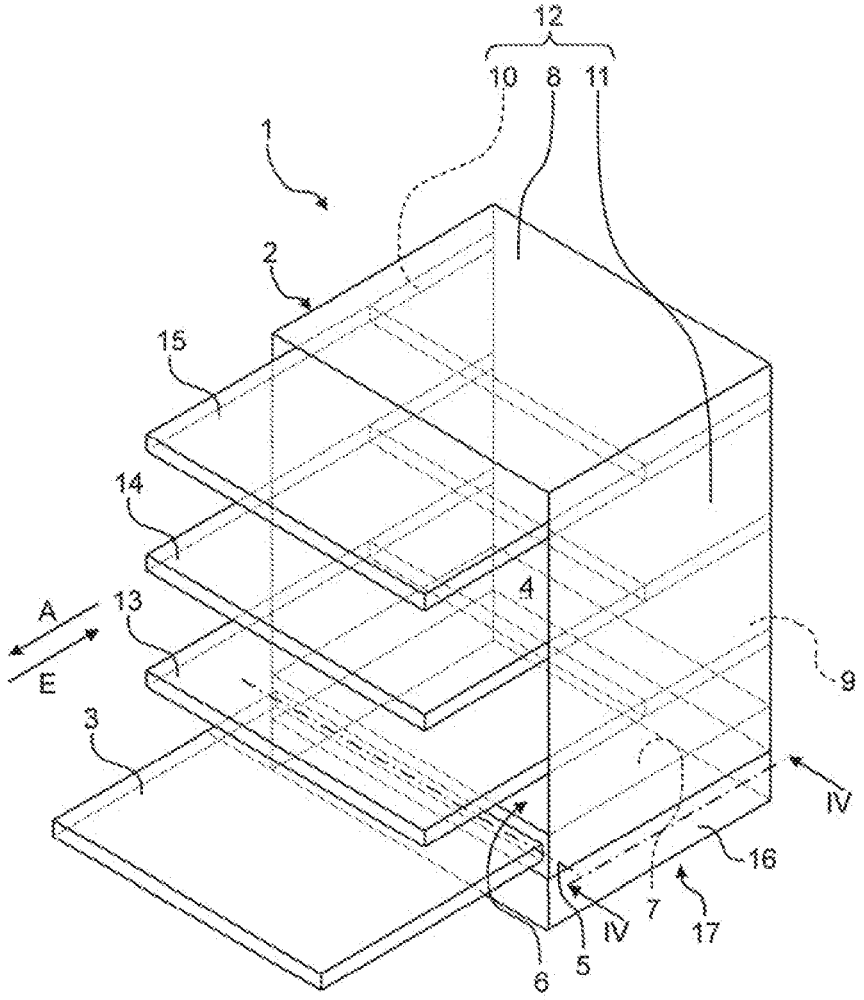
FIG. 1 shows a schematic perspective view of an embodiment of a household appliance.

In the figures, elements that are identical or have the same function are provided with the same reference characters unless otherwise stated.

FIG. 1 shows a schematic perspective view of a household appliance 1. The household appliance 1 is for example a water-using household appliance, in particular a household dishwasher. Alternatively, the household appliance 1 can be embodied as a washing machine, as a refrigeration device, for example as a refrigerator, or as an oven. The household appliance 1 comprises a dishwasher cavity 2, which can be closed by a door 3, in particular in a watertight manner. To this end, a sealing facility can be provided between the door 3 and the dishwasher cavity 2. The dishwasher cavity 2 is preferably cuboid in shape. The dishwasher cavity 2 and the door 3 can form a dishwasher interior 4 for washing items to be washed.

The door 3 is shown in its opened position in FIG. 1. The door 3 can be closed or opened by pivoting about a pivot axis 5 provided on a lower end of the door 3. A loading opening 6 of the dishwasher cavity 2 can be closed or opened with the aid of the door 3. The dishwasher cavity 2 has a base panel 7, a ceiling 8 arranged opposite the base panel 7, a rear wall 9 arranged opposite the closed door 3, and two side walls 10, 11 arranged opposite one another. The base panel 7, the ceiling 8, the rear wall 9 and the side walls 10, 11 can be manufactured from a sheet steel, for example. For example, the base panel 7 can be manufactured from a different material to that of the ceiling 8 and the side walls 10, 11.

A first side wall 10, a second side wall 11 and the ceiling 8 arranged between the first side wall 10 and the second side wall 11 are embodied in one piece, in particular from a single piece of material, and form a dishwasher cavity casing 12 of the dishwasher cavity 2. The dishwasher cavity casing 12, the rear wall 9 and the base panel 7 are components manufactured separately from one another, which are connected to one another in a watertight manner, however.

The household appliance 1 also has at least one receptacle for items to be washed 13 to 15. A number of, for example three, receptacles for items to be washed 13 to 15 can preferably be provided, wherein the receptacle for items to be washed 13 can be a lower receptacle for items to be washed or a bottom basket, the receptacle for items to be washed 14 can be an upper receptacle for items to be washed or an upper basket and the receptacle for items to be washed 15 can be a cutlery drawer. As also shown in FIG. 1, the receptacles for items to be washed 13 to 15 are arranged one above the other in the dishwasher cavity 2. Each receptacle for items to be washed 13 to 15 can optionally be moved in or out of the dishwasher cavity 2. Each receptacle for items to be washed 13 to 15 is able to be inserted into the dishwasher cavity 2 in an insertion direction E and extracted from the dishwasher cavity 2 in an extraction direction A opposite to the insertion direction E.

A base housing 16 is arranged underneath the dishwasher cavity 2. The dishwasher cavity 2 is preferably permanently connected to the base housing 16. For example, the base housing 16 and the dishwasher cavity 2 form a housing 17 of the household appliance 1. The housing 17 for example comprises further housing sections (not shown) which surround and cover the dishwasher cavity 2.

A washing cavity, a refrigeration cavity or a cooking cavity can also be provided instead of the dishwasher cavity 2.

Figure 2:
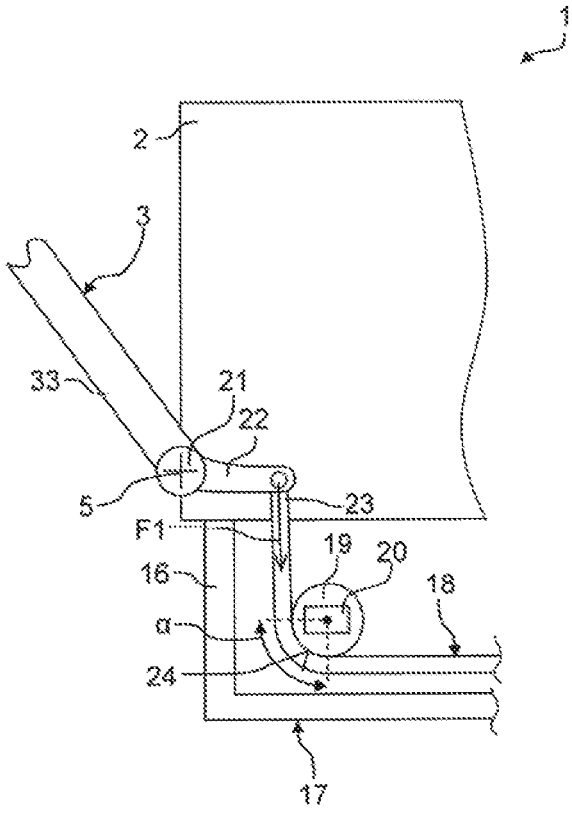
FIG. 2 shows a schematic side view of a further embodiment of a household appliance.

FIG. 2 shows a schematic side view of a further embodiment of the household appliance 1. In this case the household appliance 1 comprises the housing 17, the door 3 pivotably connected to the housing 17, a cable 18 connected to the door 3, a roller 19 in contact with the cable 18, and a motor 20 which is designed to drive the roller 19 to move the cable 18 such that a pivoting movement of the door 3 is brought about.

The door 3 further comprises a lever 22 to which one end 23 of the cable 18 is connected. The door 3, the motor 20 and the cable 18 are designed such that a change in a tensile force F1 on the lever 22 with the aid of the motor 20 and the cable 18 brings about the pivoting movement of the door 3. For this the roller 19 is connected to, so as to be driven by, the motor 20.

The door 3 is for example connected to the housing 17 with the aid of a hinge 21. In this case the pivot axis 5 runs through the hinge 21. The door 3 further comprises a plate-shaped door section 33, which when the door 3 is closed covers or closes the loading opening 6 (see FIG. 1). The roller 19 and the cable 18 are designed such that a transfer of drive force from the roller 19 to the cable 18 takes place exclusively with the aid of a friction force-fit. A friction surface 24 is arranged between the roller 19 and the cable 18 for this. The friction force-fit takes place for example with the aid of cable friction. In this case the cable 18 winds around the roller 19 along a peripheral angle which can be referred to as wrap angle $\alpha$. For example, the wrap angle $\alpha$ is between 90° and 540°. In this case the wrap angle $\alpha$ remains substantially constant during the movement of the cable 18 with the aid of the roller 19.

Figure 3:
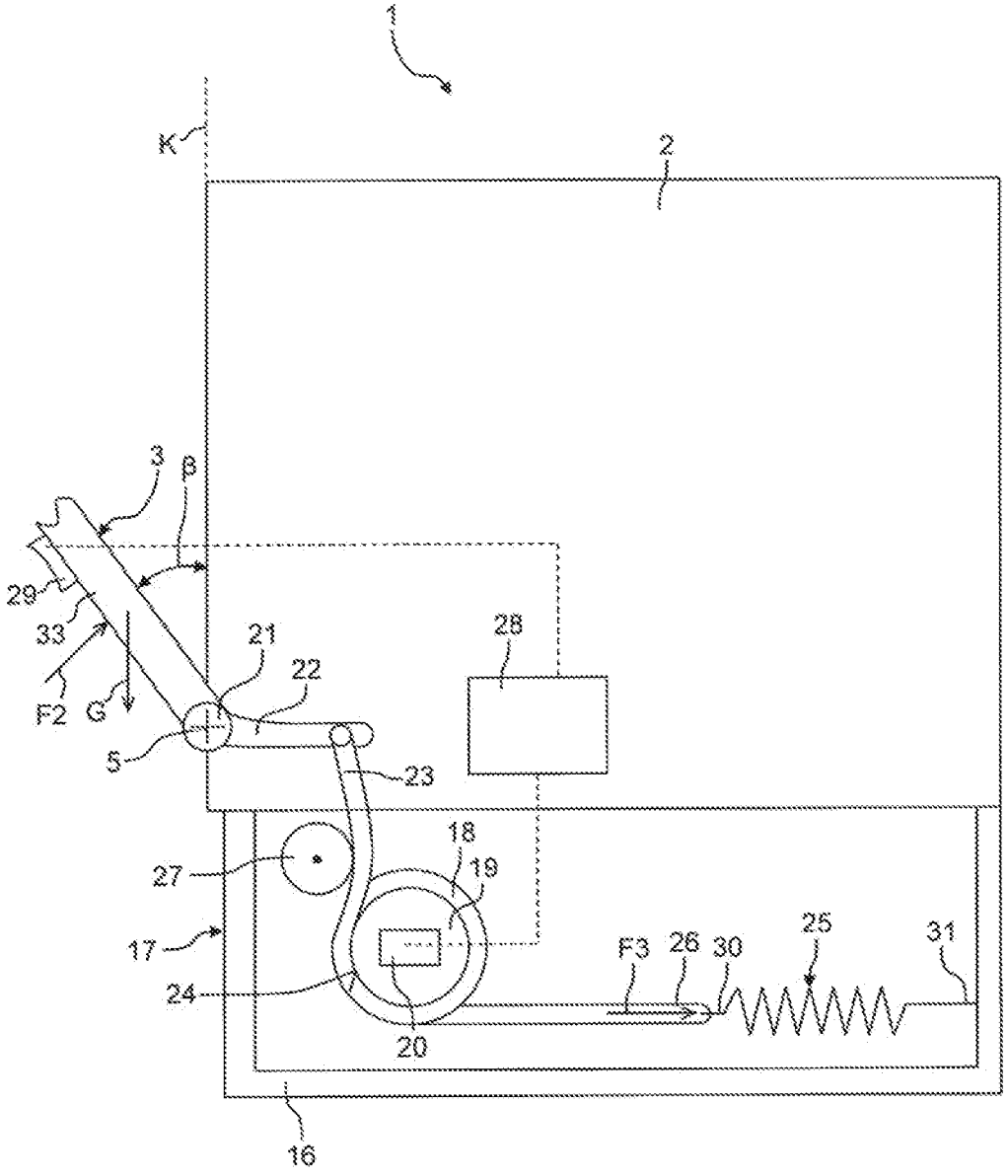
FIG. 3 shows a schematic side view of a further embodiment of a household appliance.

FIG. 3 shows a schematic side view of a further embodiment of the household appliance 1, which further develops the embodiment shown in FIG. 2. In contrast to FIG. 2 the cable 18 has the wrap angle $\alpha$ around the roller 19 of between 360° and 540°, preferably between 400° and 500°, further preferably between 425° and 475° and even more preferably between 445° and 455°. For example, the wrap angle $\alpha$ is precisely 450°. This can also be referred to as 1.25 cable windings around the roller 19. Advantageously with such a wrap angle $\alpha$ a maximum tensile force which pulls on the lever 22 can be set or limited.

The household appliance 1 also comprises a spring element 25 which is connected to the housing 17 and to the cable 18 and is designed to compensate at least partially for a weight G of the door 3. In this case another end 26 of the cable 18 is connected to the spring element 25. For example, the spring element 25 is embodied as a screw spring and a tensile spring. The spring element 25 comprises an end 30 which is connected to the end 26 of the cable 18. The spring element 25 further comprises an end 31 which is permanently connected to the base housing 16. If the motor 20 now drives the roller 19 such that the door 3 completes an opening movement, the spring element 25 is elongated.

The household appliance 1 also comprises a deflection roller 27 which is designed to deflect the cable 18 between the roller 19 and the door 3. A cable run can for example be configured with the aid of the deflection roller 27. For example, with the aid of the use of the deflection roller 27 the wrap angle $\alpha$ can be increased or adapted to the basic geometric conditions of the housing 17. The cable 18 and the roller 19 are further designed such that when an opening angle $\beta$ of the door 3 is changed by a manual force F2 acting on the door 3 the cable 18 slides over the roller 19. This takes place in particular if the load on the spring element 25 is abruptly relieved, in particular in the event of a rapid closing of the door 3 by means of the manual force F2, and a spring force F3 pulls on the end 26 of the cable 18 when the roller 19 is locked. The opening angle $\beta$ here is an angle which is spanned between the door section 33 and a vertical plane K, through which the pivot axis 5 runs. The household appliance 1 is for example designed such that an interaction of spring force F3 and weight G of the door 3 at each opening angle $\beta$ of the door 3 enables slip-free winding of the cable onto the roller 19 and unwinding of the cable 18 from the roller 19.

The household appliance 1 further comprises a control device 28 which is designed to actuate the motor 20 such that the pivoting movement of the door is brought about. For example, the control device 28 is designed to actuate the motor 20 such that the door 3 executes a complete opening movement and/or a partial opening movement and/or a complete closing movement and/or a partial closing movement. For this the control device 28 and the motor 20 are coupled to one another using signaling technology (indicated by a dashed line). For example, the household appliance 1 comprises a user interface 29 which is designed to communicate with the control device 28 to actuate the motor 20. The user interface 29 preferably comprises a push button, a touch display, a microphone, a sensor or another input device.

The roller 19 and/or the cable 18 and/or the spring element 25 and/or the motor 20 and/or the lever 22 can for example be provided redundantly and can for example be arranged along the side walls 10, 11 (see FIG. 1).

Figure 4:
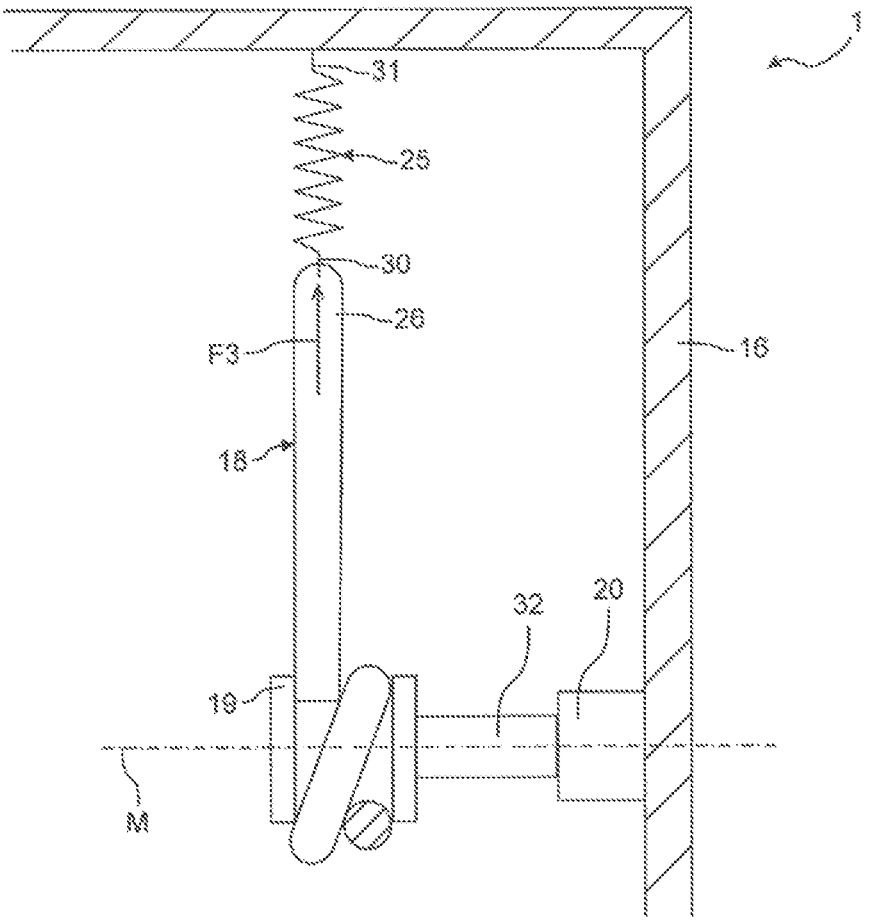
FIG. 4 shows the cross-section IV-IV from FIG. 1.

FIG. 4 shows a partial cross-section IV-IV from FIG. 1. The cross-section IV-IV here runs through the base housing 16. The motor 20 is connected to, so as to be driven by, the roller 19, with the aid of a gearing 32, in particular a worm gearing. In this case the gearing 32 is arranged between the motor 20 and the roller 19. The roller 19 is rotated about a central axis M with the aid of the motor 20 and the gearing 32. The roller 19 for example has a rotational symmetry in respect of the central axis M. For example, the gearing 32 is designed to inhibit the movement of the roller 19 if a torque is applied to the roller 19 from outside the gearing 32. This case can for example occur if a user opens the door 3 manually, so that the spring force F3 pulls on the end 26 of the cable 18 and as a result applies a torque to the roller 19. If such a spring force F3 for example exceeds a particular amount, the cable 18 slides over the roller 19. Abrasion resistance is then produced on the friction surface 24.

Although the present invention has been described with reference to exemplary embodiments, it can be modified in numerous different ways.

REFERENCE CHARACTERS USED

1 Household appliance
2 Dishwasher cavity
3 Door
4 Dishwasher interior
5 Pivot axis
6 Loading opening
7 Base panel
8 Ceiling
9 Rear wall
10 Side wall
11 Side wall
12 Dishwasher cavity casing
13 Receptacle for items to be washed
14 Receptacle for items to be washed
15 Receptacle for items to be washed
16 Base housing
17 Housing
18 Cable
19 Roller
20 Motor
21 Hinge
22 Lever
23 An end
24 Friction surface
25 Spring element
26 End
27 Deflection roller
28 Control device
29 User interface
30 End
31 End
32 Gearing
33 Door section
A Extraction direction
E Insertion direction
F1 Tensile force
F2 Manual force
F3 Spring force
G Weight
K Vertical plane
M Central axis
α Wrap angle
β Opening angle

The invention claimed is:

1. A household appliance, comprising:
a housing;
a door pivotably connected to the housing;
a cable connected to the door;
a roller in contact with the cable;
a motor configured to drive the roller to move the cable such as to effect a pivoting movement of the door;
a control device configured to actuate the motor so as to cause the pivoting movement of the door; and
a user interface configured to communicate with the control device to actuate the motor.

2. The household appliance of claim 1, constructed in the form of a water-using household appliance.

3. The household appliance of claim 2, wherein the water-using household appliance is a household dishwasher.

4. The household appliance of claim 1, wherein the roller and the cable are configured to effect a transfer of drive force from the roller to the cable exclusively via a friction force-fit.

5. The household appliance of claim 1, wherein the door includes a lever, to which one end of the cable is connected, the door, the motor and the cable being configured to cause the pivoting movement of the door in response to a change in a tensile force on the lever effected by the motor and the cable.

6. The household appliance of claim 1, further comprising a spring element connected to the housing and to the cable, said spring element configured to at least partially compensate for a weight of the door.

7. The household appliance of claim 1, wherein the cable has a wrap angle around the roller of between 360° and 540°.

8. The household appliance of claim 1, wherein the cable has a wrap angle around the roller of between 400° and 500°.

9. The household appliance of claim 1, wherein the cable has a wrap angle around the roller of between 425° and 475°.

10. The household appliance of claim 1, wherein the cable has a wrap angle around the roller of between 445° and 455°.

11. The household appliance of claim 1, wherein the motor is connected in driving relationship to the roller.

12. The household appliance of claim 11, further comprising a gearing, said motor being connected in driving relationship to the roller via the gearing.

13. The household appliance of claim 12, wherein the gearing is a worm gearing.

14. The household appliance of claim 12, wherein the gearing is configured to inhibit a movement of the roller.

15. The household appliance of claim 1, wherein the control device is configured to actuate the motor such that the door executes a complete opening movement and/or a partial opening movement and/or a complete closing movement and/or a partial closing movement.

16. The household appliance of claim 1, wherein the cable and the roller are configured to slide the cable over the roller when an opening angle of the door changes as a result of a manual force acting on the door.

17. The household appliance of claim 1, wherein the motor is embodied as an electric motor, as a hydraulic motor or as a pneumatic motor.

18. The household appliance of claim 1, further comprising a deflection roller configured to deflect the cable between the roller and the door.

* * * * *